United States Patent [19]

Rhoades

[11] Patent Number: 4,765,353

[45] Date of Patent: Aug. 23, 1988

[54] PAINT ROLLER SHIELD WITH INTEGRAL WASHING SPRAY GUARD

[76] Inventor: Clark J. Rhoades, 181 Tweed Blvd., Nyack, N.Y. 10960

[21] Appl. No.: 118,019

[22] Filed: Nov. 6, 1987

[51] Int. Cl.[4] ..... B08R 3/02

[52] U.S. Cl. ..... 134/138; 134/183; 134/200; 68/213

[58] Field of Search ..... 134/138, 182, 183, 200, 134/198; 68/213

[56] References Cited

U.S. PATENT DOCUMENTS

| | | | |
|---|---|---|---|
| 2,938,369 | 5/1960 | Bixel | 134/138 X |
| 3,133,548 | 5/1964 | Carr | 134/138 |
| 3,139,891 | 7/1964 | Faustman | 134/138 |
| 3,422,828 | 1/1969 | Dommer | 134/138 |
| 4,130,124 | 12/1978 | Sherwin | 134/138 |
| 4,569,099 | 2/1986 | Harding | 134/182 X |
| 4,593,428 | 6/1986 | Calvert | 134/138 X |
| 4,667,363 | 5/1987 | Calvert | 134/138 |

OTHER PUBLICATIONS

Photocopies of "Mr. Longarm", and literature therefor, manufactured by Mr. Longarm Inc., Greenwood, Missouri, no date available.

*Primary Examiner*—Harvey C. Hornsby
*Assistant Examiner*—Frankie L. Stinson
*Attorney, Agent, or Firm*—John H. Crozier

[57] ABSTRACT

A shield for a paint roller is adapted for washing a paint roller while the roller is mounted within the shield. The paint shield includes a splash guard that when not being used for washing, is rotated into a splatter guard. When the roller is to be washed, the spray shield is rotated to cover the opening defined by the splatter guard. The spray shield has openings defined therein so that wash water may drain therethrough while through which little or no watery paint spray may pass. A water hose is attached to the splatter guard which supplies water to a chamber which includes a slot extending the length of the roller and which includes holes positioned to direct sprays of water at the roller bearings. In a preferred embodiment, a second chamber is provided to have liquid soap placed therein which mixes with the water to aid in cleaning the roller. The paint shield includes a unique handle attachment which is adjustable from its normal position orthogonal to the major axis of the roller, so that, for example, the portion of a ceiling over furniture may be painted without the need for moving the furniture. An additional unique feature provides for completely cleaning the journal and bearing structures provided for the roller. The bearing journals are covered by the shield to prevent paint dripping out of the side of the shield and smearing adjacent surfaces.

12 Claims, 3 Drawing Sheets

PAINT ROLLER SHIELD WITH INTEGRAL WASHING SPRAY GUARD

BACKGROUND OF THE INVENTION

1. Field of the Invention

This invention relates to paint roller shields generally, and more particularly to such a shield which includes means for washing the roller with water and which includes means to prevent splashing of water as the roller is being washed.

2. Background Art

A number of devices have been devised to aid in the washing of paint rollers.

(1) U.S. Pat. No. 3,428,060, to Spivey, describes a chamber into which a paint roller which has been removed from its painting apparatus is inserted. A first water spray drives an impeller which rotates the roller and a second water spray is directed onto the roller as it is rotated. This method protects the surroundings from being sprayed with watery paint, but requires that a device separate from the painting apparatus be provided and also that the paint-filled roller must be handled while being inserted into the device.

(2) U.S. Pat. No. 3,825,970, to Hanssen, describes an integral paint shield which assists in roller cleaning by allowing it to be placed on its edge while a water stream is directed at the roller. This affords spray protection only to the area immediately behind the shield.

(3) U.S. Pat. No. 4,545,396, to Kolb, describes a paint roller adapted to be chucked in an electric drill and rotated in a pail of cleaning liquid.

(4) U.S. Pat. No. 4,446,590, to Kirchner, Jr. et al., describes a device somewhat similar to (1), except that the same water spray both rotates and washes the roller.

(5) U.S. Pat. No. 4,448,209, to Lindsay, describes a more complicated version of (1) and (4).

(6) U.S. Pat. No. 4,549,562, to Ossi, describes a lid for a paint tray, which lid includes orifices which direct a water spray at the roller which is positioned in its handle between the lid and the tray. While considerably less complicated than (1), (4), and (5), this method also requires the use of a device separate from the painting apparatus.

(7) U.S. Pat. No. 4,569,099, to Harding, describes a paint roller washing shield somewhat similar to (2), with the same limitations.

(8) U.S. Pat. No. 4,593,428, to Calvert, describes a paint roller shield having a threaded removable handle. When the handle is removed, a water hose may be attached to the threaded connection on the shield to supply washing water to a fan-shaped slot which extends partially along the length of the roller to direct water thereon to thereby clean it. A disadvantage of this arrangement is that the portions of the roller near its ends do not receive the same degree of cleaning as the center of the roller, and the bearings receive no direct spray at all. While this method requires no device separate from the painting apparatus, it provides the same limited shielding from watery paint spray as do (2) and (7).

(9) U.S. Pat. Nos. 2,896,244, to Crosh; 3,029,458, to Balicki; 3,058,145, to Hegedus; 3,112,729, to Prezioso, Jr.; 3,115,659, to Church; 3,274,637, to Schulze; 3,378,872, to Frontera, et al.; 3,538,532, to Shorting, et al.; 3,748,683, to Smith, et al.; 3,970,396, to Brady; 4,063,325, to Lizak; and 4,254,529, to Cooke, describe various paint roller shields not involving washing methods or means.

Each of the cleaning methods or means noted above suffers from one of two limitations. If there is complete protection from watery paint spray, a separate apparatus is required. If there is no separate apparatus, complete protection from watery paint spray is not afforded.

Accordingly, it is a principal object of the present invention to provide means for washing a paint roller which means is integral to the splatter guard normally used with a paint roller and which provides substantially complete protection from watery paint spray while the roller is being washed.

A further object of the present invention is to provide means to add soap to the wash water.

An additional object of the present invention is to provide a paint roller shield in which the bearing journals are covered by the shield to prevent paint dripping out of the side of the shield and smearing adjacent surfaces.

Yet a further object of the present invention is to provide means to allow resting the paint roller shield on a surface while the roller is being washed, without the surface interferring with the washing operation.

Yet another object of the present invention is to provide a paint roller shield having a handle that folds against the shield to facilitate storage and shipping.

It is another object of the present invention to provide such means that is economical and of simple manufacture.

Other objects of the present invention will, in part, be obvious and will, in part, be evident from the following description.

SUMMARY OF THE INVENTION

The present invention overcomes the limitations of the above devices by providing a paint shield which includes a spray shield that when not being used for washing, is rotated into the splatter guard. When the roller is to be washed, the splash guard is rotated to cover the opening defined by the splatter guard. The spray shield has slotted openings defined therein so that wash water may drain therethrough while through which little or no watery paint spray may pass. A water hose is attached to the paint shield which supplies water to a chamber which includes a slot extending the length of the roller and which includes holes positioned to direct sprays of water at the roller bearings. In a preferred embodiment, the chamber is adapted to have liquid soap placed therein which mixes with the water to aid in cleaning the roller. The paint shield includes a unique handle attachment which is adjustable from its normal position orthogonal to the major axis of the roller, so that, for example, the portion of a ceiling over furniture may be painted without the need for moving the furniture. The handle may also be folded parallel with the major axis of the paint shield to facilitate storage and shipping. An additional unique feature provides for completely cleaning the bearing structure provided for the roller.

DETAILED DESCRIPTION OF THE PREFERRED EMBODIMENTS

Figure 1:
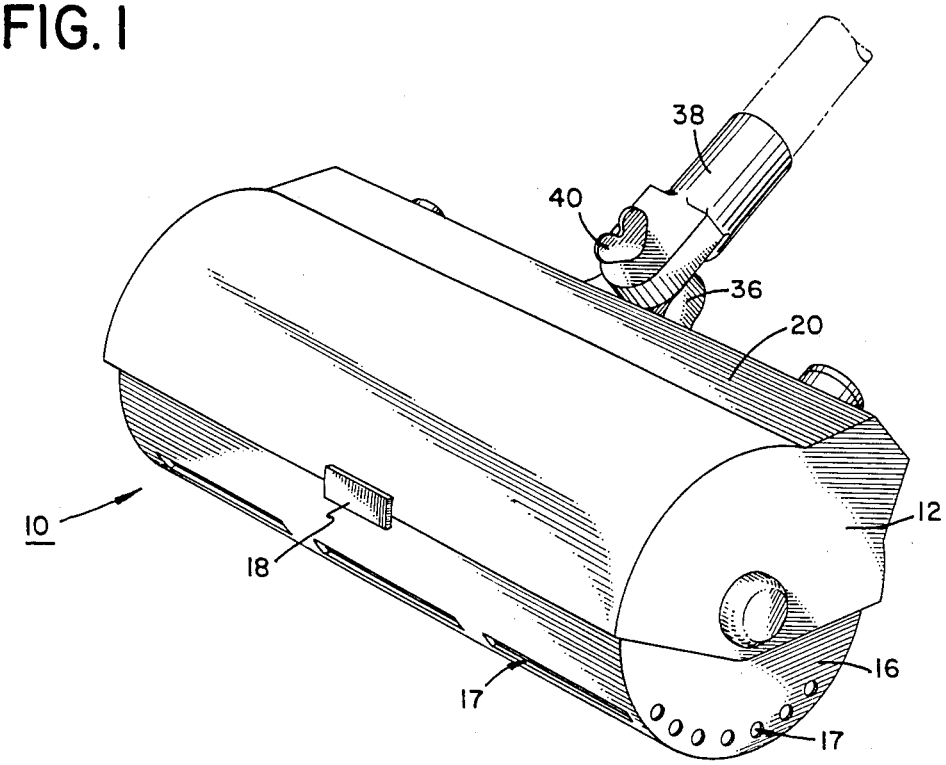
FIG. 1 is a perspective view of a paint shield constructed according to the present invention, showing the spray shield in place for washing the paint roller.
Figure 2:
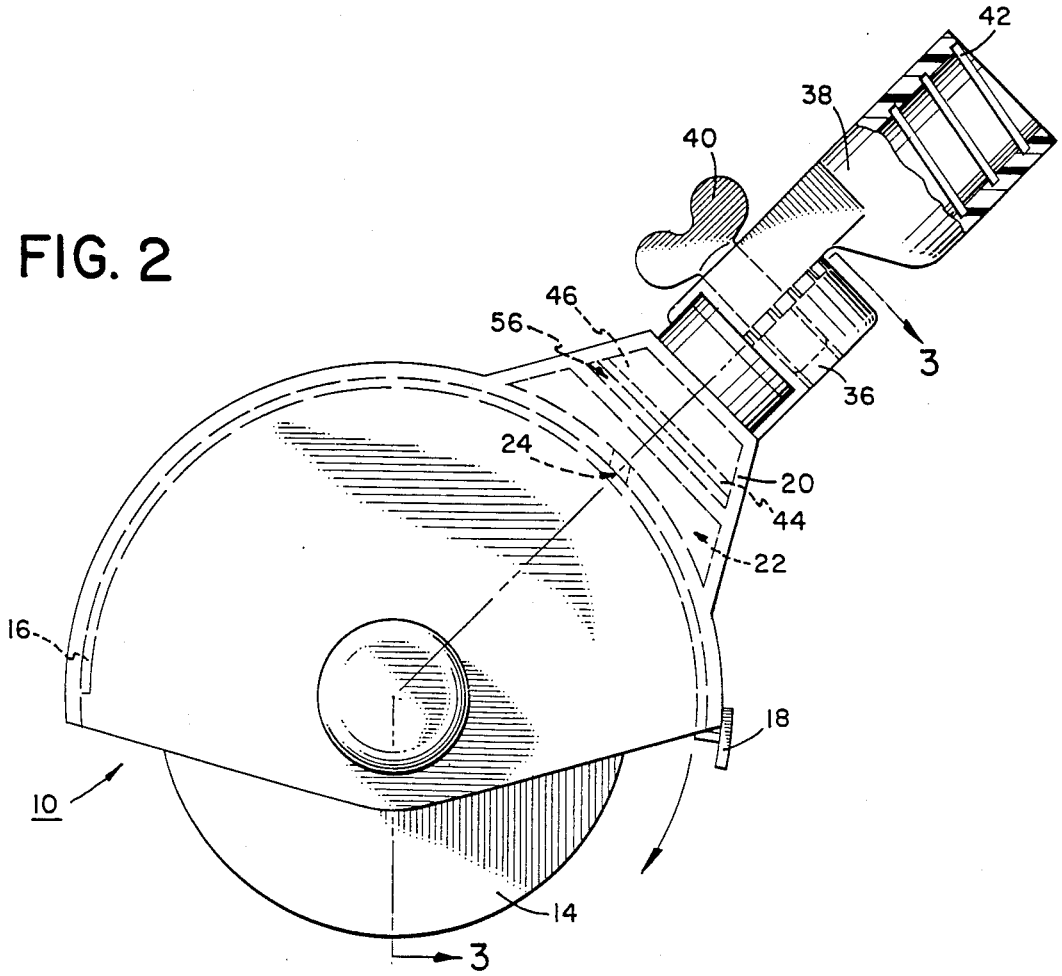
FIG. 2 is a side view of the paint shield of the present invention, with the spray shield in position for using the paint roller for painting.
Figure 3:
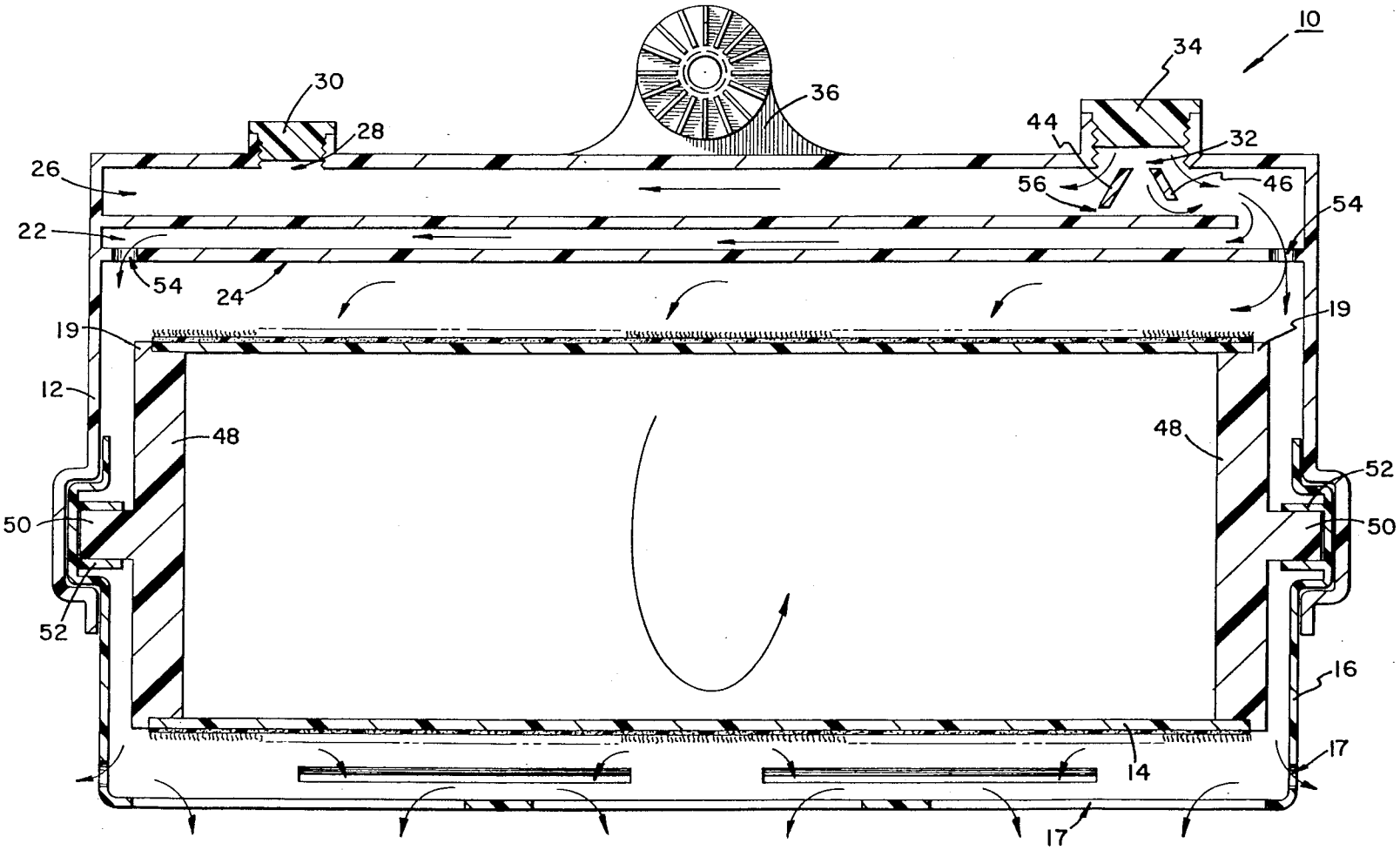
FIG. 3 is a cross-sectional view of a paint shield of the present invention, showing internal details of a preferred embodiment.

Referring now to the Drawing, FIG. 1 is a perspective view, FIG. 2 is a side view, and FIG. 3 is a cross-sectional view of the paint roller shield of the present invention, generally indicated by the reference numeral 10, which includes a splatter guard 12 which prevents splattering of paint onto other objects when the paint roller 14 is being used and a spray shield 16 which prevents watery paint spray from contacting other objects when the roller is being washed. Spray shield 16 has openings defined therein, as at 17, for the flow therefrom of wash water. Spray shield 16 is shown in FIG. 1 in position for washing paint roller 14, and is shown in FIG. 2 rotated into splatter guard 12 when the paint roller is to be used for painting. Spray shield 16 is held against rotation in splatter guard 12 by clasp means 18 which is attached to the spray shield and which releasably engages an edge of the splatter guard by friction.

Formed on splatter guard 12 may be a housing 20 internal of which is a water chamber 22, and a slot 24 located to direct a spray of water against, and to cause to rotate, paint roller 14 when the roller is being washed. Slot 24 must be so oriented that each diameter roller to be used will be rotated by the water spray. Housing 20 may include a soap chamber 26, a soap inlet 28 with cap 30, and a water inlet 32 with cap 34.

Also formed on splatter shield 12 may be a ledge 36 to which a handle fixture 38 is rotatably attached by means of a threaded wing nut 40. Handle fixture 38 is hollow at the distal end and may have coarse threads formed therein, as at 42, to removably accept a wooden handle or the like (not shown). This is a convenient feature which offers two advantages. First, different length handles may be used with the same paint shield. Second, the rotation allowed, as described below, makes it convenient to paint, for example, a section of ceiling over objects such as furniture without having to move such objects.

Also shown on the cross-sectional view of FIG. 3 are first and second baffles 44 and 46, respectively, paint roller supports 48, journals 50, bearings 52, and holes 54. Spray shield 16 is shown in position for the washing of paint roller 14. Spray shield 16 is rotatably journaled in splatter guard 12 as shown and has formed thereon bearings 52 in which journals 50 rotate to allow rotation of paint roller 14. Journals 50 are mounted on paint roller supports 48 which are removably inserted in paint roller 14 and held therein by friction. The ends of paint roller 14 butt against lips 19 formed at the ends of paint roller supports.

In the washing operation, soap is added to soap chamber 26 through soap inlet 28. It will be understood that a separate soap inlet is optional and that soap could be instead added through water inlet 32. Cap 34 is removed from water inlet 32 and a threaded hose which may be an ordinary garden hose (not shown) is attached to the water inlet. When the water is turned on, some of it is directed into water chamber 22 by second baffle 46 and some of it is directed into soap chamber 26 by first baffle 44. The water directed into soap chamber 26 mixes with the soap therein and passes through orifice 56 at the base of first baffle 44 and into the water being directed into water chamber 22. From water chamber 22, the soapy mixture passes through slot 24 as a spray which impinges on paint roller 14 causing it to rotate and washing it. Holes 54 at the ends of slot 24 ensure that journals 50 and bearings 52 receive a good supply of water for the thorough washing thereof. It should be noted that slot 24 extends across the length of splatter shield 12 to ensure thorough washing of paint roller 14.

Figure 4:
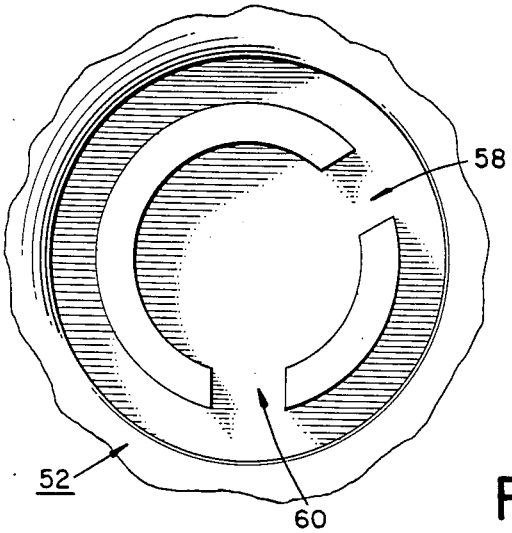
FIG. 4 is a detail view showing the construction of the bearings shown on FIG. 3.
Figure 5:
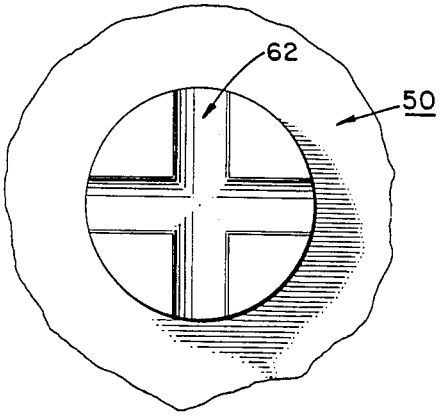
FIGS. 5 and 6 are detail views of the journals shown on FIG. 3.
Figure 6:
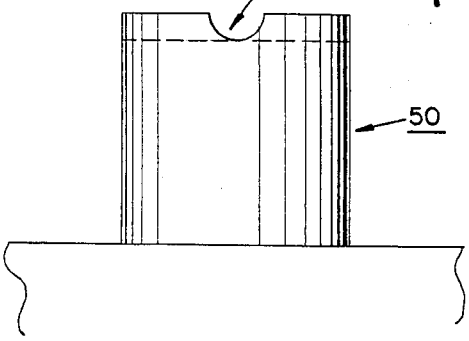

FIGS. 4, 5, and 6 are details of FIG. 3, showing the structures which permit thorough washing of journals 50 and bearings 52. Bearing 52 has a first opening 58 which is located near the upper end of the bearing so as to receive a stream of water directed toward it by hole 54. Bearing 52 also has a second opening 60 through which the water may drain. First and second openings 58 and 60 preferably extend the full length of bearing 52. Some of the water entering bearing 52 flows along journal 50 to the end thereof and the washing of the end of journal 50 and the corresponding surface of bearing 52 is facilitated by cruciform slots 62 formed in the end of the journal. FIG. 6 indicates the depth of cruciform slots 62 shown on FIG. 5.

Figure 7:
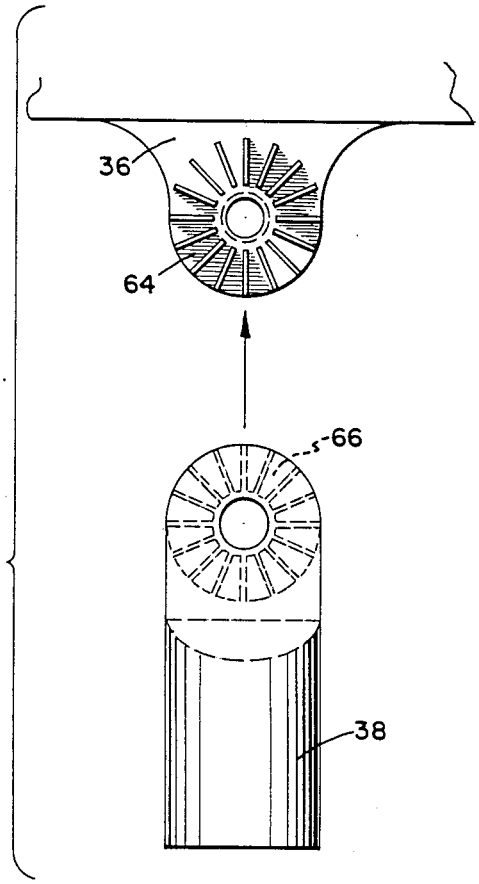
FIGS. 7 and 8 are detail views showing the adjustable handle construction of the a paint shield of the present invention.
Figure 8:
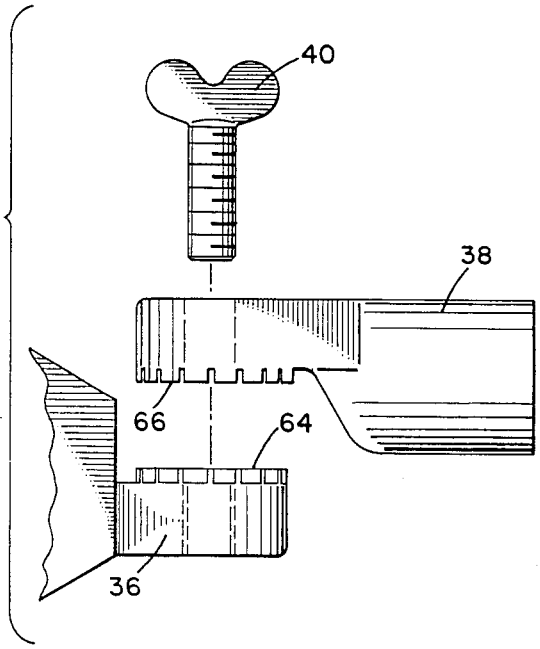

FIGS. 7 and 8 show a preferred construction of the handle attachment means shown on previous figures. In addition to the elements described above, the figure shows a first series of raised ridges on ledge 36, as at 64, which cooperate with corresponding ridges, as at 66, on handle fixture 38 to provide for fixing a handle (not shown) in adjustable positions so that the handle may form an acute angle with the major axis of paint shield 10 to provide the desirable adjustment described above. This adjustment feature also allows the handle (not shown) to be folded parallel with the major axis of paint shield 10 to facilitate storage and shipping.

All elements of paint shield 10 may be conveniently and economically manufactured by the injection molding of a thermoplastic material, although any suitable means or materials known in the art may be employed for manufacturing the various elements, the one or ones chosen not being part of the present invention. The sides of splatter guard 12 should have sufficient resiliency that they may be spread apart slightly to allow insertion of paint roller 14.

It is also within the intent of the present invention to provide spray shield 16 that is not integral with splatter guard 12, but is removable so that, in a first position, it is positioned for washing paint roller 14 as shown on FIG. 1, and, when it is in a second position, it is removed from the splatter guard and the roller may be used for painting.

Thus, what has been described is a paint roller shield having improved means to facilitate washing of the roller while the roller is mounted in the shield.

It will thus be seen that the objects set forth above, among those made apparent from the preceding description, are efficiently attained and, since certain changes may be made in the above construction without departing from the scope of the invention, it is intended that all matter contained in the above description or shown on the accompanying Drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A shield for a paint roller, comprising:

(a) a splatter guard partially surrounding the surface and ends of said paint roller;

(b) means for rotatably mounting said paint roller within said splatter guard;

(c) means integral with said splatter guard to permit washing said paint roller while said paint roller is mounted within said splatter guard; and (d) spray shield means cooperating with said splatter guard and movable between first and second positions; whereby, when said spray shield means is in said first position, said spray shield means contains watery paint spray while said paint roller is being washed, and when said spray shield means is in said second position, said paint roller may used for painting.

2. A shield for a paint roller, as defined in claim 1, wherein said spray shield means includes openings formed therein for the draining of wash water therefrom.

3. A shield for a paint roller, as defined in claim 1, wherein said means integral with said splatter guard, comprises:

(a) a water chamber adapted to be connected to a source of pressured water; and (b) a slot formed along one wall of said water chamber and extending substantially the length of said paint roller, so as to direct a stream of water at said roller, thereby rotating and washing said roller.

4. A shield for a paint roller, as defined in claim 3, further comprising holes formed in said one wall of said water chamber to direct streams of water at bearings in which said paint roller is journaled.

5. A shield for a paint roller, as defined in claim 4, wherein said bearings have openings defined therein for the inlet and outlet of water, so that water directed thereat washes the surfaces of said bearings and the surfaces of journals rotating within said bearing.

6. A shield for a paint roller, as defined in claim 5, wherein said journals have slots formed on the ends thereof to facilitate washing of said ends and of the bearing surfaces which they contact.

7. A shield for a paint roller, as defined in claim 5, wherein said journals are covered by said shield to prevent paint dripping out of the side of said shield and smearing adjacent surfaces.

8. A shield for a paint roller, as defined in claim 3, further comprising an integral soap chamber into which soap may be placed to mix with the wash water.

9. A shield for a paint roller, as defined in claim 1, further comprising adjustable means for mounting a handle such that the major axis of said handle may form an acute angle with the major axis of said paint roller shield.

10. A shield for a paint roller, as defined in claim 9, wherein said handle may be adjusted so that said handle is parallel with the major axis of said shield.

11. A shield for a paint roller, as defined in claim 9, wherein said adjustable means comprises:

(a) a ledge formed on said splatter guard;

(b) a first set of ridges formed on a surface of said ledge;

(c) a handle fixture;

(d) a second set of ridges formed on a surface of said handle fixture; and (e) means to urge together said first and second sets of ridges, thereby holding said handle fixture in a selected position.

12. A shield for a paint roller, as defined in claim 11, wherein said handle fixture includes means for removably attaching said handle.

* * * * *